US011236588B2

(12) United States Patent
Barfoed et al.

(10) Patent No.: US 11,236,588 B2
(45) Date of Patent: Feb. 1, 2022

(54) METHOD AND APPARATUS FOR VERIFYING A WELL MODEL

(71) Applicant: WELLTEC A/S, Allerød (DK)

(72) Inventors: Jens Barfoed, Copenhagen SV (DK); Malene Ulleriks Nielsen, Frederikssund (DK)

(73) Assignee: WELLTEC A/S, Allerød (DK)

( * ) Notice: Subject to any disclaimer, the term of this patent is extended or adjusted under 35 U.S.C. 154(b) by 146 days.

(21) Appl. No.: 15/126,649

(22) PCT Filed: Mar. 17, 2015

(86) PCT No.: PCT/EP2015/055506
§ 371 (c)(1),
(2) Date: Sep. 16, 2016

(87) PCT Pub. No.: WO2015/140136
PCT Pub. Date: Sep. 24, 2015

(65) Prior Publication Data

US 2017/0089179 A1 Mar. 30, 2017

(30) Foreign Application Priority Data

Mar. 18, 2014 (EP) ..... 14160528

(51) Int. Cl.
*E21B 47/00* (2012.01)
*E21B 47/07* (2012.01)
(Continued)

(52) U.S. Cl.
CPC ..... *E21B 41/0092* (2013.01); *E21B 47/00* (2013.01); *E21B 47/07* (2020.05); *E21B 47/12* (2013.01)

(58) Field of Classification Search
CPC ..... E21B 47/00
(Continued)

(56) References Cited

U.S. PATENT DOCUMENTS 6,324,904 B1 * 12/2001 Ishikawa ..... E21B 47/011 257/E29.022
2010/0283788 A1 * 11/2010 Rothnemer ..... E21B 47/002 345/473

(Continued)

FOREIGN PATENT DOCUMENTS

WO WO 2013/098363 7/2013

OTHER PUBLICATIONS

International Search Report and Written Opinion of the ISA for PCT/EP2015/055506, dated Aug. 5, 2015, 9 pages.

*Primary Examiner* — Robert E Fuller
*Assistant Examiner* — Lamia Quaim
(74) *Attorney, Agent, or Firm* — Nixon & Vanderhye P.C.

(57) ABSTRACT

The present invention relates to a method for verifying a well model, comprising the steps of receiving stored well data of an existing well, forming a model based on the received well data, submerging a tool for performing a work task into the existing well, wherein the tool is arranged to sense present well characteristics when submerged, receiving tool data corresponding to the presently sensed well characteristics from the tool, said tool data representing downhole properties relevant to downhole operation and performance of the tool, and performing a confirmation check by comparing the well data of the model with the tool data. Furthermore, the present invention relates to a well model verifying apparatus, to a well model verifying system and to a computer readable storage medium.

22 Claims, 3 Drawing Sheets

(51) Int. Cl.
*E21B 47/12* (2012.01)
*E21B 41/00* (2006.01)

(58) Field of Classification Search
USPC ..... 166/250.1; 703/10
See application file for complete search history.

(56) References Cited

U.S. PATENT DOCUMENTS

| | | | | |
|---|---|---|---|---|
| 2011/0060572 | A1* | 3/2011 | Brown | E21B 43/00 703/10 |
| 2011/0106514 | A1* | 5/2011 | Omeragic | G01V 11/00 703/10 |
| 2011/0166843 | A1* | 7/2011 | Hsu | G01V 11/00 703/10 |
| 2011/0272147 | A1 | 11/2011 | Beasley et al. | |
| 2013/0124176 | A1 | 5/2013 | Fox et al. | |
| 2014/0214325 | A1* | 7/2014 | Wessling | E21B 47/06 702/11 |
| 2014/0284103 | A1* | 9/2014 | Niina | E21B 47/00 175/24 |
| 2015/0205002 | A1* | 7/2015 | Liang | G01V 1/303 703/2 |

* cited by examiner

METHOD AND APPARATUS FOR VERIFYING A WELL MODEL

This application is the U.S. national phase of International Application No. PCT/EP2015/055506 filed 17 Mar. 2015, which designated the U.S. and claims priority to EP Patent Application No. 14160528.7 filed 18 Mar. 2014, the entire contents of each of which are hereby incorporated by reference.

FIELD OF THE INVENTION

The present invention relates to a method for verifying a well model. Furthermore, the present invention relates to a well model verifying apparatus, to a well model verifying system and to a computer readable storage medium.

BACKGROUND ART

An existing well for production of hydrocarbon-containing fluid may be represented by a series of data values in order to facilitate downhole operation. For example, during the design phase (i.e. before drilling), the well bore is defined in terms of dimensions and directions. Typically, these data values are arranged in a table so that the entire well is represented numerically. During the drilling operation, new values may be added to the table so that the table also includes real values obtained during the drilling operation. An additional table may also be provided including data relating to the completion, i.e. information about casing length, casing components etc.

Once the well is producing, or even in the pre-production phase, e.g. during completion, it may be necessary to perform various operations downhole. These operations require that tools are submerged downhole, and typical tools include perforators, key tools, stroker tools, cleaning tools, logging tools, etc. In order to provide efficient and safe operation of such tools, it is beneficial to know as much as possible about the downhole environment, especially at the position of the required operation.

Should the well be in need of a tool operation, it is therefore important to determine the position and the expected conditions downhole. Before the operation, the table may therefore be accessed to confirm well characteristics—the table may e.g. reveal that the tool may be able to pass without any restrictions, as well an expected temperature range below the maximum operation temperature of the tool. This kind of information is then used to decide whether to perform the operation or not, and using which tools.

In view of the above, the accuracy of the well tables is of high importance. Should e.g. the actual temperature be higher than the corresponding table specification, the tool electronics may be damaged or even completely destroyed. Another possibility is that a restriction is not defined in the table, while actually being present. In such cases, the tool may be stuck downhole.

Although well data facilitates and improves tool operation, there is a need for new methods and apparatuses for verifying the well data in order to avoid the problems described above.

SUMMARY OF THE INVENTION

It is an object of the present invention to wholly or partly overcome the above disadvantages and drawbacks of the prior art. More specifically, it is an object to provide an improved method and apparatus for verifying the well data in order to avoid the problems of a malfunctioning tool or the tool getting stuck.

The above objects, together with numerous other objects, advantages and features, which will become evident from the below description, are accomplished by a solution in accordance with the present invention by a method for verifying a well model, comprising the steps of:

- receiving stored well data of an existing well,
- forming a model based on the received well data,
- submerging a tool for performing a work task into the existing well, wherein the tool is arranged to sense present well characteristics when submerged,
- receiving tool data corresponding to the presently sensed well characteristics from the tool, said tool data representing downhole properties relevant to downhole operation and performance of the tool, and
- performing a confirmation check by comparing the well data of the model with the tool data.

Preferably, tool data represents downhole properties associated with, or relevant to, downhole operation and performance of the tool. Hence, the confirmation check will provide valuable information regarding the accuracy of the well model, wherein the level of accuracy is provided for the well characteristics relevant for the tool operation and performance.

Throughout this specification, an existing well is to be interpreted as a well into which a downhole tool may be submerged. The existing well may thus be a well at least partly drilled. The existing well may also be a fully drilled well, however having no or only some part of it completed, i.e. being provided with a casing. The existing well may also be a fully completed well ready for production, be in production, or be in the process of being reviewed in order to produce again.

The method according to the present invention may further comprise the step of controlling the operation state of the tool based on the output from the confirmation check.

Said well data may comprise survey data obtained during designing the well, and/or survey data obtained during drilling of the well, and/or completion data, and/or intervention data obtained during well operation, and/or wellbore characteristics including temperature and/or pressure and/or flow.

Moreover, the well data may comprise survey data and at least one of completion data, intervention data, or wellbore characteristics.

In an embodiment, said model may be a 3D model.

Further, the model may represent at least a predetermined extension of the well.

The step of forming the model may further comprise the step of loading predetermined data representing tool characteristics into the model.

Also, the step of receiving tool data may be performed continuously or at regular intervals during operation of the tool.

The method as described above may further comprise the step of loading the received tool data into the model after the step of performing a confirmation check.

Moreover, the step of loading the received tool data may be performed repeatedly, continuously or at regular intervals.

In an embodiment, the model may be updated after each repetition.

Further, the method as described above may further comprise the step of processing tool data so that it corresponds to wellbore characteristics.

Also, the method as described above may further comprise the step of extrapolating the model from the received tool data.

In addition, the method as described above may further be configured to allow multiple users, or stakeholders, to access the model, so that a first user may access a first part of the model, while a second user may access a second part of the model simultaneously in a multi-user mode. The first part and the second part may overlap, e.g. in cases when the first part is a zoomed-in portion of the second part.

Furthermore, the multi-user mode may be available while receiving tool data and performing a confirmation check by comparing the well data of the model with the tool data.

The method may further comprise the step of transmitting a control signal to the submerged tool for changing the operation state of the tool.

The present invention also relates to a well model verifying apparatus, wherein said apparatus is configured to:

receive stored well data of an existing well, form a model based on the received well data, submerge a tool for performing a work task into the existing well, wherein the tool is arranged to sense present well characteristics when submerged, receive tool data corresponding to the presently sensed well characteristics from the tool, and perform a confirmation check by comparing the well data of the model with the tool data.

Preferably, tool data may represent downhole properties associated with, or relevant to, downhole operation and performance of the tool.

Furthermore, the present invention relates to a well model verifying system comprising a downhole tool and a well modifying apparatus as described above.

Finally, the present invention relates to a computer readable storage medium encoded with instructions that, when loaded and executed on a controller of an apparatus, may cause the method as described above to be performed.

It should be realised that the embodiments of the method may also be realised for other aspects of the invention, such as the apparatus.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
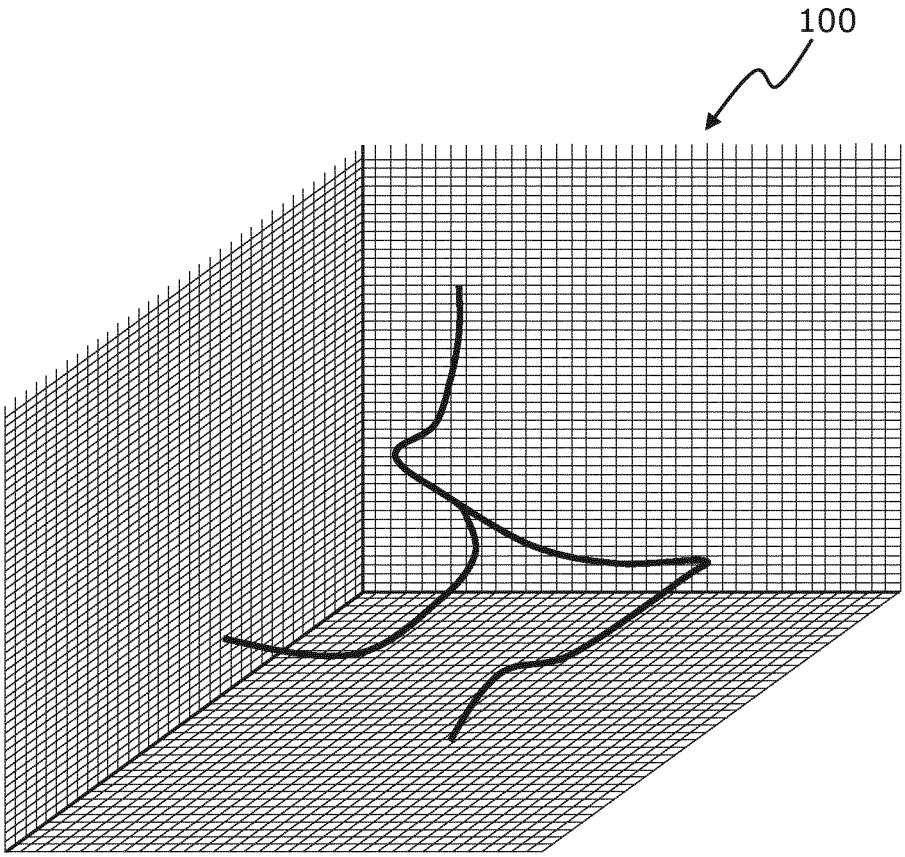
FIG. 1 shows a visual representation of a well model according to an embodiment.

FIG. 1 shows an example of a visualisation of a 3D model 100 for a user. The model 100 forms a representation of various available well data, so-called a priori data. The model 100 is preferably represented in three dimensions using orthogonal coordinates, such as the Cartesian coordinates used in FIG. 1. The model 100 allows a user to zoom in and zoom out for visualising different levels of well details also while the tool is operating. FIG. 1 shows an overview of the well, whereby the model 100 is configured to show the entire extension of the well from its upper end to its lower end, including all laterals.

Figure 2:
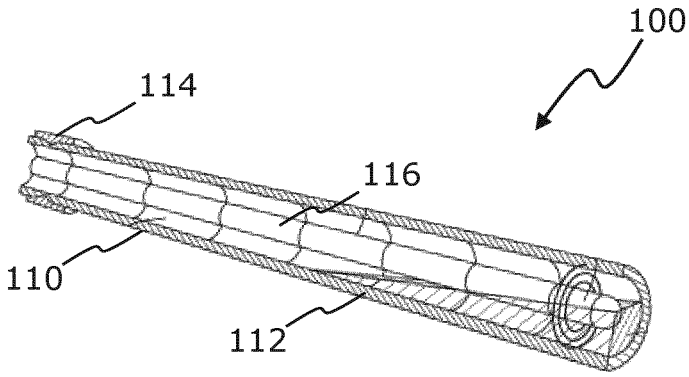
FIG. 2 shows a visual representation of a well model according to a further embodiment.

In FIG. 2, the model 100 is used to visualise a portion 110 of the well in further detail. The model 100 does not only comprise data of how the well 110 is propagating through the coordinate system, but the model may also, in cases where the existing well is at least to some extent ready for production, include detailed information on well completion 112, packer position 114, tool 116 propagation and operation, etc. Hence, it is possible for a user, or an operator, to actually use the model for retrieving various types of data of the well.

As has been described above, the model may preferably be used for tool operation planning and performance. The model, being a mathematical representation of the well and its components, is preferably built by means of a game engine having real time 3D rendering capabilities providing a scene graph in accordance with available 3D modelling principles and techniques. Hence, the model may be accessible by means of computer hardware and associated software including e.g. a video card, a processor, memory, and a display.

The model 100 is preferably provided as a computer-based, simulated environment, i.e. a virtual world, for which the game milieu defining the well and its characteristics is accessible for different users, or stakeholders, at different levels. The model 100 may be accessible via internet, thereby allowing different stakeholders to actually interact with the model 100 even though they are located remote from each other physically.

Now turning to FIG. 3, a method 200 according to an embodiment will be described. One advantage of the method 200 is that it allows real time verification of pre-existing models. The method 200 thereby allows a user, such as a well operator or a downhole tool technician, to receive real time confirmations or alarms of the properties downhole, which properties may be relevant, i.e. important or even crucial, for assessing downhole operation and performance. In this way, the well operator or a downhole tool technician can be given a warning in the event that e.g. the temperature is higher than expected and thus given the opportunity to stop the operation before the electronics is damaged. As an alternative, the operator or technician can prompt the client owning or operating the well that the operation might fail due to a temperature in the well which is higher than expected.

The method 200 begins with a first step 202 of accessing stored well data from a memory, such as a table or other database structure. The stored well data should in this context be interpreted as any existing data describing or relating to a specific condition downhole. Such condition may e.g. be structural conditions such as dimensions, thickness, extension, angle, material, etc., or physical conditions such as temperature, flow, pressure, corrosive substances, etc.

In one embodiment, step 202 is performed by addressing a first table or database for accessing survey data obtained during designing the well, addressing a second table or database for accessing survey data obtained during drilling of the well, addressing a third table or database for accessing completion data, addressing a fourth table or database for accessing intervention data obtained during well operation, and addressing a fifth table or database for accessing wellbore characteristics like temperature, pressure or flow. Although step 202 could be performed by addressing only one table or database for accessing well data, it should be realised that the accessed well data may vary depending on the particular application and on the quality and scope of the background material, including well data. For example, in the event that the existing well is a well currently being subject to completion operation, there may be no relevant data in the third, fourth, and fifth tables described above.

Once step 202 is performed, the accessed well data is loaded for forming 204 a model of the existing well from the accessed and loaded well data. Step 204 may be performed in many different ways. However, it is appreciated that one advantageous way is to provide the model as a semi-finished well model, only requiring specific well data for finishing the 3D model and the representation of the existing well. The model may thus be provided as a framework defining only generic structures and parameters such that the well data, once loaded into the model framework, provides sufficient information for establishing a model of the existing well.

In order to verify the well model, the method 200 further comprises a step 206 of operating a tool in the well. The tool may be one of many available tools for downhole operations, such as logging tools having capacitance sensors, magnetic sensors, positioning sensors, temperature sensors, pressure sensors, orientation sensors, ultrasonic sensors, or lasers. The tool may in other embodiments be an expansion tool for expanding annular barriers, or an operation tool such as a key tool for sliding valve sleeves, milling or drilling heads, perforators, strokers, or cleaning tools.

Step 206 thus provides that the tool is submerged into the existing well, and the method 200 further comprises the step 208 of receiving tool data from the tool, e.g. from a sensor in the tool. The tool data is selected so that it corresponds to well characteristics, i.e. structural or physical properties downhole. For example, well characteristics may e.g. be downhole temperature, while associated tool data is a voltage signal. In another example, well characteristics may be casing position, whereas tool data is a magnetic signal which varies along the casing.

In a final step 210, the method 200 thereafter performs a verification step by doing a confirmation check. For this purpose, step 210 includes comparing the well data of the model with the tool data. A match between the actual tool data and the predetermined well data of the model will confirm, or verify, the accuracy of the model. A mismatch, on the other hand, will imply that the well model is not reflecting the real conditions downhole.

Step 210 may preferably be performed by implementing a threshold function. Hence, the step of verifying the well model may comprise comparing the tool data with the well data from the model and computing, or calculating, a ratio between these two values. Should the ratio lie above a predetermined threshold, the well model is considered to be reliable, meaning that a ratio below the predetermined threshold will result in the well model being considered to be unreliable, and optionally in need of updating.

In one embodiment, the method 200 further comprises a set of additional steps performed in series or in parallel with the previously described steps 202-210. In a step 212, tool characteristics are also loaded into the model. Tool characteristics may e.g. be tool dimensions such as length, width, etc., or other tool properties such as operational speed, traction force, etc. Tool characteristics may either be constant values, such as predetermined and well-defined tool dimensions, or variable values which need to be provided in real time. Such tool characteristics may be operational speed etc.

Step 212 may consequently be performed upon start-up of the method 200, as well as during tool operation. By loading tool characteristics into the model, it is possible for a user of the modelling software to visualise also the tool when interacting with the well. By continuously or at regular intervals providing tool characteristics to the model, it is thus possible to track the tool when moving downhole by visualising the dynamic behaviour of the tool. The model thereby allows a user to obtain real time animations of the tool in the well.

Figure 3:
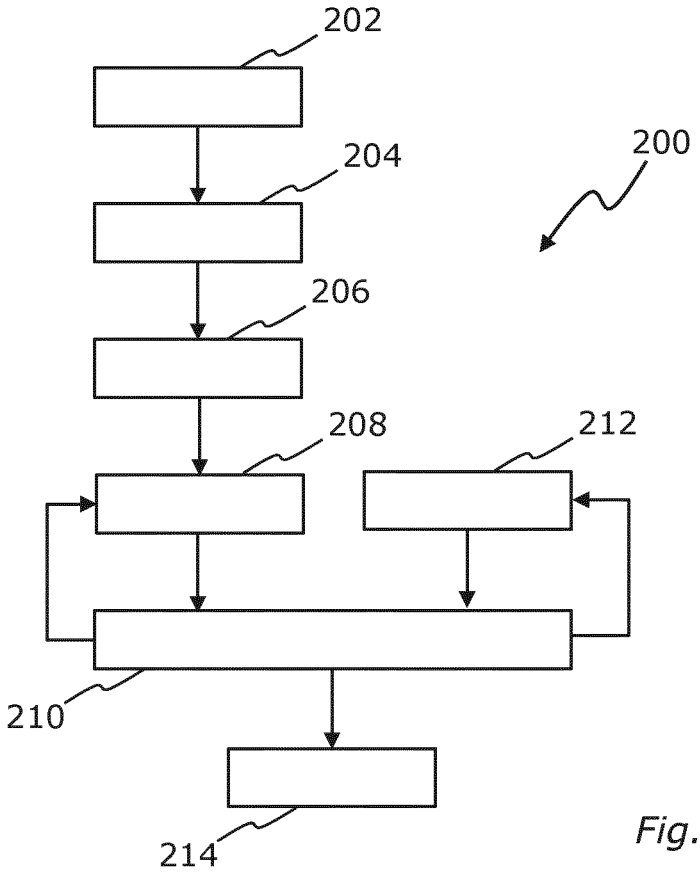
FIG. 3 shows a method according to an embodiment.

As can be seen in FIG. 3, step 208, i.e. the step of receiving tool data from the downhole tool, is performed repeatedly during operation of the tool. Tool data may thus be continuously provided and loaded into the model, whereby the already existing well data may be subject to verification using the latest tool data corresponding to the most recent properties of the well.

The method 200 is thus configured to provide an efficient way of verifying a well model by comparing pre-existing well data, such as a priori information determined e.g. during the design phase, the drilling phase, the completion phase, or during previous tool operations forming intervention data, with tool data. The tool data may be subject to a method step in which it is converted to well characteristics as has already been described above.

The method 200 may in some embodiments comprise an additional step 214 in which the well data of the model is used to extrapolate the model; either in space or in time. For example, there may be some portions of the well which have not been explicitly defined during the design phase, the drilling phase, the completion phase, or during previous interventions. Further to this, it may be concluded when performing the method that for some portions of the well, the well model is clearly wrong and does not represent the actual well accurately. Step 214 may in those cases be performed in order to extrapolate the portions of the model which are determined to be accurate, such that the erroneous portions are replaced by the extrapolation.

In other embodiments, step 214 is performed in order to predict future behaviour of the well. For example, a certain portion of the well may be modelled at several different occasions (like drilling, completion, interventions, etc.), whereby the modelled portion is varying with time. This may be the case when water breakthrough is approaching, whereby flow and temperature downhole are changing over time. When knowing how the model changes over time, it is also possible to predict future behaviour, thereby allowing a user or well operator to make proactive decisions on necessary actions.

Some specific embodiments utilising predictive algorithms will now be discussed. A specific oil/gas field may comprise several platforms, each platform including one or several wells. Should a model of measured data already exist for one or more wells extending from the same platform or in the same oil field, the well characteristics as defined in the modelled well may be used to model a new well within the same oil field. The well characteristics that may be shared by the new well include e.g. temperature profile. Extrapolating model data from one well to another may also be performed in cases where two wells within the same (or an adjacent) oil field have been modelled at different times. Should one well have been modelled two years prior to a second well, the difference between these two models may be used to predict future behaviour, such as water breakthrough, of the well within the oil field. Modelled wells from previous operations in the same well or adjacent wells can thus also be used to determine if the water breakthrough is increasing or decreasing, or when such water breakthrough is likely to occur in the future, e.g based on decreasing temperature between two runs. Further to this, such information may also provide important guidelines to which tools are necessary downhole. In addition, previous data from one well can be used to determine whether an operation is suitable in an adjacent well, e.g. if the temperature is likely to be too high for certain electric components, e.g. sensors.

Figure 4:
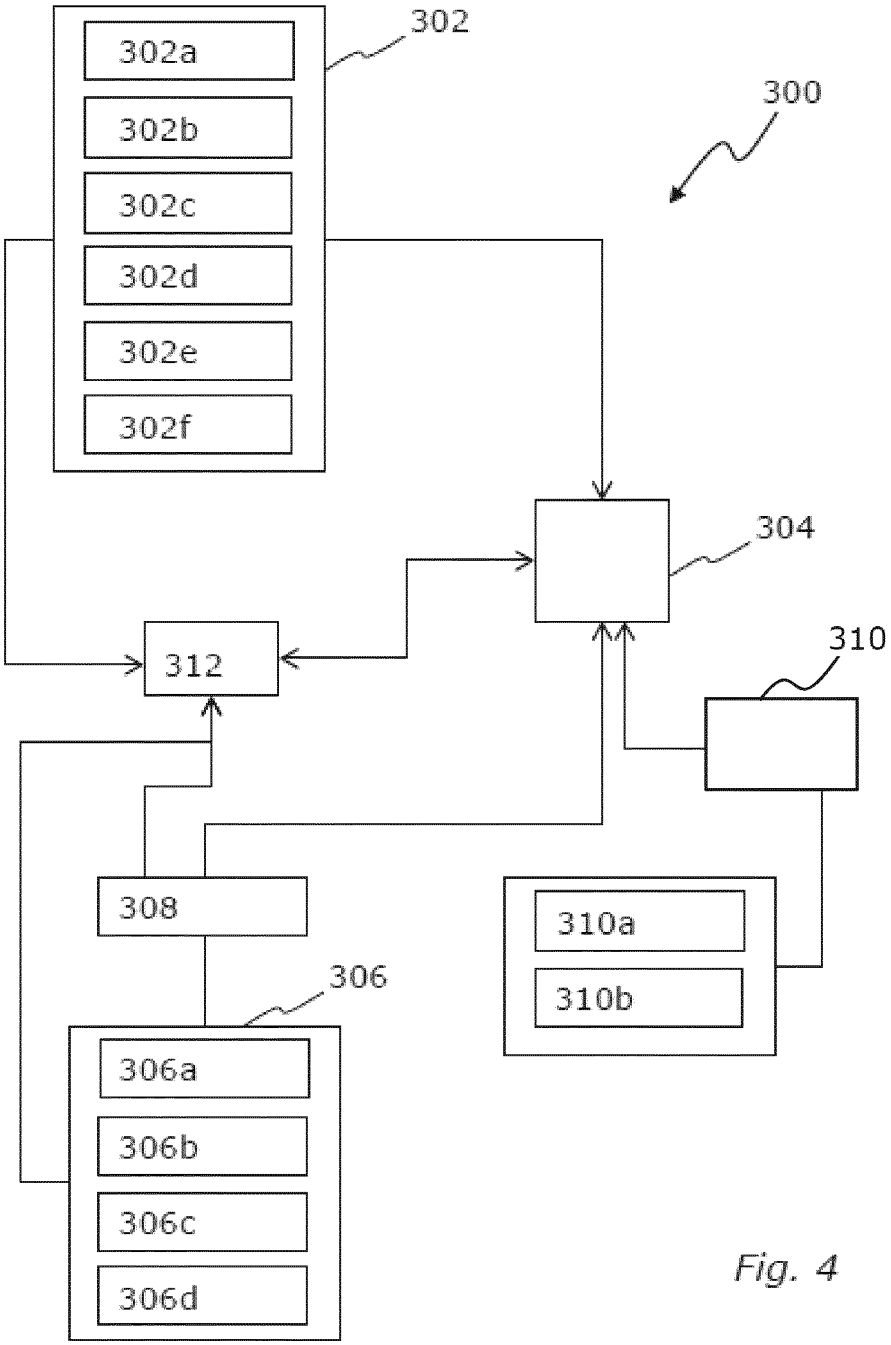
FIG. 4 shows a schematic view of an apparatus according to an embodiment.

Now turning to FIG. 4, an apparatus 300 configured to verify a well model is shown. The apparatus 300 comprises suitable computer hardware, such as processor(s), memory, display, radio communication means, etc. as well as computer software for generating the well model and for allowing a user, or well operator, to navigate through the model. The apparatus 300 thus forms a platform which covers not just the real time operations onshore, but also the entire job realisation process; from scenario thinking, pre-job planning through operations and post-job follow-up, hosting all the relevant and interested parties by performing embodiments of the method 200 described above.

The apparatus further allows teams to collaborate in three-dimensional scenes of the virtual world of the model, which can transition fluently from grand overviews spanning miles all the way down to cross sections featuring details in millimetres.

The virtual working environment provided by the apparatus 300 is able to encompass available data both historically and in real time. By operating an apparatus 300, a common frame of reference is provided from the early stages of planning and scenario thinking to job execution and review. At any stage of the process, teams may be allowed to share questions, concerns, notes and warnings, which then become part of the model environment made available by means of the apparatus 300.

Further to this, the apparatus 300 makes it possible to control intervention tools directly from within the platform so off-site personnel will be able not just to monitor and communicate but also to participate directly in ongoing operations in real time.

In some embodiments, a plurality of stakeholders may simultaneously have access to the model 100 via the apparatus 300. Should the stakeholders not be present at the physical location of the apparatus 300, they may e.g. connect to the model 100 via internet. Stakeholders may e.g. include operators and field engineers, as well as other people having specific interest in the well. The apparatus 300 may advantageously allow different stakeholders to have different permissions, meaning that an operator may e.g. only have "viewer" rights, while a field engineer may have "viewer" rights as well as "update model" rights. When several stakeholders are accessing the same model 100, they may choose their own part of the virtual world; a first stakeholder may choose to view the model in a zoom-out view, while a second stakeholder may at the same time view only a small part of the model, such as the part in which the tool is arranged or moving. Of course these two views may overlap.

The apparatus 300 is configured to generate and handle the model by having all model elements being based on real data and to scale. The apparatus 300 is preferably configured to use colour schemes and codings for facilitating user experience and operation of the model. For example, if assumptions are made in the model, they are visualised with colour coding for transparency.

The apparatus 300 is preferably configured to subscribe only to current surface readout, thereby requiring only decreased bandwidth and reducing the risk for the software to interfere with ongoing operations.

Again referring to FIG. 4, the apparatus 300 is configured to receive well data of an existing well, form a model based on the received well data, receive tool data corresponding to well characteristics from a tool being submerged into the existing well, and perform a confirmation check by comparing the well data of the model with the tool data.

For this purpose, the apparatus 300 comprises a memory 302 storing a priori well data used to generate the model. A prior data may e.g. be survey data 302*a* from the design phase or the drilling phase, and/or completion data 302*b*, and/or measurement data 302*c* from intervention processes, and/or calculations 302*d* either from survey data or from measurement data, and/or notes 302*e*, and/or logged diagnosis 302*f*. The memory 302 is in connection with a model generator 304, which comprises various hardware and software for building and visualising the model. The model generator 304 thus acts as a controller for the apparatus, which controller is configured to execute various commands in order to enable the model to be generated.

The apparatus 300 further comprises a tool data module 306 which is configured to receive and store tool data from a tool being submerged in an existing well. The existing well is the same well as that represented by the well data of the memory 302. The tool data module 306 may for this purpose comprise communication means, either wireless radio communication modules or wired input channels, for receiving the tool data. Further to this, the module 306 may comprise a calculating unit 308 which is configured to calculate well characteristics from the tool data in accordance with the description above. The module 306 is in connection with the model generator 304, either directly or via the calculating unit 308, so that the tool data may be used as an input to the model generator 304.

Tool data may e.g. be a tool string file 306*a* storing predetermined tool characteristics, notes 306*b*, real time measurements 306*c* or calculations 306*d*. Hence, the tool data may represent the tool itself or the environment in which the tool is currently operating.

The model generator 304 is in some embodiments further connected to a tool control 310 for allowing a user of the apparatus 300 to perform real time control of the tool operating downhole. Hence, the apparatus 300 is thus not only configured to verify the well model, but also provides control functionality, whereby a tool operator is allowed to control the tool. Tool control may be achieved by connecting the tool control module 310 directly to the tool 310*a* itself or via winch and cables or wireline 310*b* used to support the tool.

For verifying the well model, the apparatus 300 further comprises a verification unit 312 connected to the model generator 304. The verification unit 312 is configured to fetch well data from the model, and to fetch tool data or corresponding well characteristics. The tool data, or its corresponding well characteristics, may either be fetched from the tool data module 306, the calculating unit 308, or from the model generator 304.

The verification unit 312 thus receives well data as well as tool data and is configured to perform a verification of the well model by comparing the well data of the model with the tool data. The verification unit 312 is preferably also configured to transmit an output to the model generator 304 for displaying the result of the verification to an operator. Hence, the model generator 304 comprises display means not only capable of visualising the model to a user or operator, but also of providing a user interface for navigating through the model as well as for controlling the tool operation downhole.

If there is a noticeable mismatch between the well model and the received tool data, the verification unit 312 may be configured to initialise an update of the well model if deemed adequate. For example, if according to the well model, the temperature at a certain position is noticeably higher than that sensed by the tool, and if it can be confirmed that the tool temperature sensing functionality appears to operate adequately, the well model may be updated with a temperature which is closer to or identical to the temperature sensed by the tool for the certain position. In some circumstances, it may be advantageous only to make minor changes to the model, such as to reduce any undesirable fluctuations or oscillations due to instrument and position error of the sensing units of the tool, as well as fluctuating ambient conditions in the vicinity of the tool when submerged. Hence, if the tool senses an instant temperature of 50° C. and the model assumes the temperature to be 30° C. at a certain position, using only this instant tool temperature, the verification unit may update the well model so that it now assumes the temperature to be 35° C. at the certain position.

Moreover, based on the verification check, the verification unit 312 may be further configured to transmit a control signal to the submerged tool for changing the operation state of the tool. The operation state of the tool may relate to:

continuing work task;
aborting work task;
updating work task;
activating/deactivating sensing functionalities; and/or
change of movement pattern.

Hence, based on the well model and the tool data, the verification unit 312 may control the operation of the tool, and if necessary change, or amend the work task.

The verification unit 312 may further be configured to issue alarms to a user or stakeholder whereby manual input to the model may be required in order to continue operation of the tool. This may preferably be used in situations in which the measured temperature downhole is higher than the temperature of the model. Before submerging the tool into the hot area, a stakeholder will thus be allowed to permit operation or not.

As has been described above, the method 200 as well as the apparatus 300 are capable of verifying a well model by comparing predetermined well data with tool data, wherein the tool data corresponds to well characteristics. Preferred embodiments include the functionality of also updating the well model in case it is determined that the well model does not correspond to actual properties downhole.

Computer hardware and/or computer software may be used to implement the embodiments described above. Examples of hardware elements comprise processors, microprocessors, integrated circuits, application specific integrated circuits (ASIC), programmable logic devices (PLD), digital signal processors (DSP), field programmable gate array (FPGA), etc. Examples of computer software comprise programs, applications, computer programs, application programs, computer code segments, etc.

In order to give some general explanations of tool operation, examples of downhole tools and their functionality are given below.

A stroking tool is a tool providing an axial force. The stroking tool comprises an electrical motor for driving a pump. The pump pumps fluid into a piston housing to move a piston acting therein. The piston is arranged on the stroker shaft. The pump may pump fluid into the piston housing on one side and simultaneously suck fluid out on the other side of the piston.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A method for verifying a well model of a well, comprising:

receiving stored well data of an existing well obtained during drilling of the well, forming a model based on the received well data, submerging an intervention tool for performing a work task into the existing well after drilling is completed and once the well is producing or during completion, wherein the intervention tool is arranged to sense present well characteristics when submerged, said intervention tool including a perforator, a key tool, a stroker tool, a cleaning tool, a logging tool or a driving tool, receiving tool data corresponding to the presently sensed well characteristics from the intervention tool, said tool data representing downhole properties relevant to downhole operation and performance of the intervention tool, and performing a confirmation check by comparing the well data used in forming the model with the tool data to confirm the accuracy of the model.

2. A method according to claim 1, further comprising controlling the operation state of the tool based on the output from the confirmation check.

3. A method according to claim 1, wherein said well data comprises intervention tool data obtained during well operation, and the well data includes one or more of survey data obtained during designing the well, and/or survey data obtained during drilling of the well, and/or completion data, and/or wellbore characteristics including temperature and/or pressure and/or flow.

4. A method according to claim 3, wherein the well data comprises survey data and at least one of completion data, or wellbore characteristics.

5. A method according to claim 1, wherein said model is a 3D model.

6. A method according to claim 1, wherein the model represents at least a predetermined extension of the well.

7. A method according to claim 1, wherein forming the model further comprises loading predetermined data representing tool characteristics into the model.

8. A method according to claim 1, wherein receiving tool data is performed continuously or at regular intervals during operation of the intervention tool.

9. A method according to claim 1, further comprising loading the received tool data into the model after performing a confirmation check.

10. A method according to claim 9, wherein loading the received tool data is performed repeatedly, continuously or at regular intervals.

11. A method according to claim 10, wherein the model is updated after each repetition.

12. A method according to claim 1, further comprising processing tool data so that it corresponds to well characteristics.

13. A method according to claim 1, further comprising extrapolating the model from the received tool data.

14. A method according to claim 1, further comprising transmitting a control signal to the submerged tool for changing the operation state of the intervention tool.

15. A method according to claim 1, wherein the method further comprises transmitting a control signal to the submerged intervention tool for changing an operation state of the intervention tool.

16. A method according to claim 1, wherein the tool data is a voltage signal or a magnetic signal.

17. A well model verifying apparatus, wherein said apparatus is configured to:

receive stored well data of an existing well obtained during drilling of the well, form a model based on the received well data, submerge an intervention tool for performing a work task into the existing well after drilling is completed and once the well is producing or during completion, wherein the intervention tool is arranged to sense present well characteristics when submerged, said intervention tool being selected from the group consisting of a perforator, a key tool, a stroker tool, a cleaning tool, and a driving tool, receive intervention tool data corresponding to the presently sensed well characteristics from the intervention tool, said intervention tool data representing downhole properties relevant to downhole operation and performance of the tool, and perform a confirmation check by comparing the well data used in forming the model with the intervention tool data to confirm the accuracy of the model.

18. A well model verifying apparatus according to claim 17 wherein the apparatus is configured to transmit a control signal to the submerged tool for changing an operation state of the intervention tool.

19. A well model verifying system, comprising a downhole tool and an apparatus according to claim 17.

20. A non-transitory computer readable storage medium encoded with instructions that, when loaded and executed on a controller of an apparatus, causes the method according to claim 18 to be performed.

21. A method for verifying a well model, comprising:

receiving stored well data of an existing well obtained during drilling of the well, forming a model based on the received well data, submerging an intervention tool for performing a work task into the existing well after drilling is completed and once the well is producing or during completion, wherein the intervention tool is arranged to sense present well characteristics when submerged, receiving tool data corresponding to the presently sensed well characteristics from the intervention tool, said tool data representing downhole properties relevant to downhole operation and performance of the intervention tool, performing a confirmation check by comparing the well data used in forming the model with the tool data to confirm the accuracy of the model, and transmitting a control signal to the submerged tool for changing the operation state of the intervention tool.

22. A well model verifying apparatus, wherein said apparatus is configured to:

receive stored well data of an existing well obtained during drilling of the well, form a model based on the received well data, submerge an intervention tool for performing a work task into the existing well after drilling is completed and once the well is producing or during completion, wherein the intervention tool is arranged to sense present well characteristics when submerged, receive tool data corresponding to the presently sensed well characteristics from the intervention tool, said tool data representing downhole properties relevant to downhole operation and performance of the intervention tool, perform a confirmation check by comparing the well data used in forming the model with the tool data to confirm the accuracy of the model, and transmit a control signal to the submerged intervention tool for changing the operation state of the intervention tool.

* * * * *